United States Patent [19]

Frye

[11] 4,119,012

[45] Oct. 10, 1978

[54] DOUBLE-FEED SPROCKET ARRANGEMENT FOR MUNITION CHANGING

[75] Inventor: Guenter Frye, Dusseldorf, Fed. Rep. of Germany

[73] Assignee: Rheinmetall GmbH, Dusseldorf, Fed. Rep. of Germany

[21] Appl. No.: 857,995

[22] Filed: Dec. 6, 1977

Related U.S. Application Data

[63] Continuation of Ser. No. 733,339, Oct. 18, 1976, abandoned.

[30] Foreign Application Priority Data

Oct. 18, 1975 [DE] Fed. Rep. of Germany ..... 2546843

[51] Int. Cl.[2] ..... F41D 9/02

[52] U.S. Cl. ..... 89/33 SF; 89/33 CA

[58] Field of Search ..... 89/33 SF, 33 BA, 33 CA

[56] References Cited

U.S. PATENT DOCUMENTS

| | | | |
|---|---|---|---|
| 1,401,667 | 12/1921 | Brown | 89/33 BA |
| 1,784,355 | 12/1930 | Herlach et al. | 89/33 SF |
| 3,789,730 | 2/1974 | Helmes | 89/33 SF |
| 4,069,740 | 1/1978 | Hottinger et al. | 89/33 SF |

*Primary Examiner*—Stephen C. Bentley

[57] ABSTRACT

An improved arrangement for selectively transferring munitions shells from a pair of opposed feed sprockets to a movable breech block of an automatic weapon is described. A pair of displacement blocks are supported for vertical movement in mutually opposite directions in vertical planes disposed between the feed sprockets and forming upward extensions as a pair of shell-stripping projections on the moving breech. Shell-receiving seats are defined on each of the displacement blocks by a pair of superposed, normally parallel support elements and the intermediate portion of the block. A reversible pinion is drivingly connected to a pair of confronting tooth racks extending from the upper ends of the respective displacement blocks. The pinions and racks are so situated that when the shell-receiving seat on one of the blocks is in its lower most position in cooperative relation with the underlying shell-stripping region of the breech, the other of the block is in an upper position out of contact with the other of the shell-stripping regions. In an intermediate position of the blocks when the seats are aligned, both of the seats are out of contact with the respective underlying shell-stripping regions to define a safety position of the shell transfer mechanism.

7 Claims, 3 Drawing Figures

DOUBLE-FEED SPROCKET ARRANGEMENT FOR MUNITION CHANGING

This is a continuation of application Ser. No. 733,339, filed Oct. 18, 1976, now abandoned.

BACKGROUND OF THE INVENTION

The invention relates to shell transfer arrangements wherein a pair of horizontally spaced, oppositely rotatable feed sprockets are adapted to selectively transfer shells in a serial manner to a breech piece which is movable through the transfer arrangement.

In a known arrangement of this type, a lever-operated, horizontally movable transfer arrangement is cooperable with the feed sprockets for selecting which of such feed sprockets is then to be coupled to the stripping region of the moving breech. Such transfer arrangement, which includes a shiftable tray having two alternative stripping stations, is relatively heavy and bulky to move and requires the expenditure of a considerable amount of force to effect a selection switching operation. In addition, such arrangement does not exhibit a reliable and substantially "fail safe" neutral safety position in which each of its two shell discharge positions are decoupled from the moving breech, so that auxiliary safety apparatus must be provided.

SUMMARY OF THE INVENTION

Such disadvantages are overcome with the improved feed sprocket-selection apparatus of the invention, which is adapted for use with a double-feed sprocket feed arrangement of the general type described above. In an illustrative embodiment, which is adapted for use with a moving breech arrangement having a pair of shell-engaging regions disposed on opposite sides of the axis of movement of the breech and extending upwardly in spaced vertical planes, the selection mechanism for the feed sprockets includes a pair of elongated, vertically disposed displacement blocks which are supported for reciprocation in mutually opposite directions in superposed relation to the shell-engaging regions of the breech. In the lower position of each block, a shell-receiving seat defined thereon by a pair of vertically spaced support arms extending outwardly from superposed regions of the block is situated in shell-stripping engagement with the underlying region of the breech. At the same time, the other of the displacement blocks has a corresponding seat in its upper position out of engagement with the underlying shell-stripping breech region.

A reversible pinion is drivingly coupled to a pair of confronting gear racks that are secured to the upper ends of the displacement blocks, so that rotation of the pinion in one direction moves one of the seats into a lower position and the opposite seat into its upper position. A reversal of motion of the pinion correspondingly reverses the relative orientations of the seats.

Each of the seats opens outwardly toward an associated one of the two feed sprockets for receiving shells therefrom. Spring-loaded camming means are associated with each of the seats for securing each of the received shells therein.

When the pinion is rotated into a neutral position wherein the seats are horizontally aligned intermediate the upper and lower positions, both of such seats are out of engagement with the underlying shell-stripping regions of the breech. Therefore, a neutral or safety position is automatically established in such orientation, whereby auxiliary safety apparatus can be dispensed with.

Moreover, because of the vertical disposition of the blocks and the gear racks and the dynamic coupling of the pinion between them, each of the displacement blocks is effectively counterweighted by the other. As a result, the net force necessary to operate the pinion, and thereby to effect a desired feed sprocket transfer operation or to set the apparatus into a neutral position, is limited to a force necessary only to overcome the friction of the pinion-gear rack assembly. Consequently, the bulk of the transfer apparatus, and the force necessary to operate such apparatus into one of its selection positions, are reduced to a minimum.

BRIEF DESCRIPTION OF THE DRAWING

The invention is further set forth in the following detailed description taken in conjunction with the appended drawing, in which.

DETAILED DESCRIPTION

Figure 1:
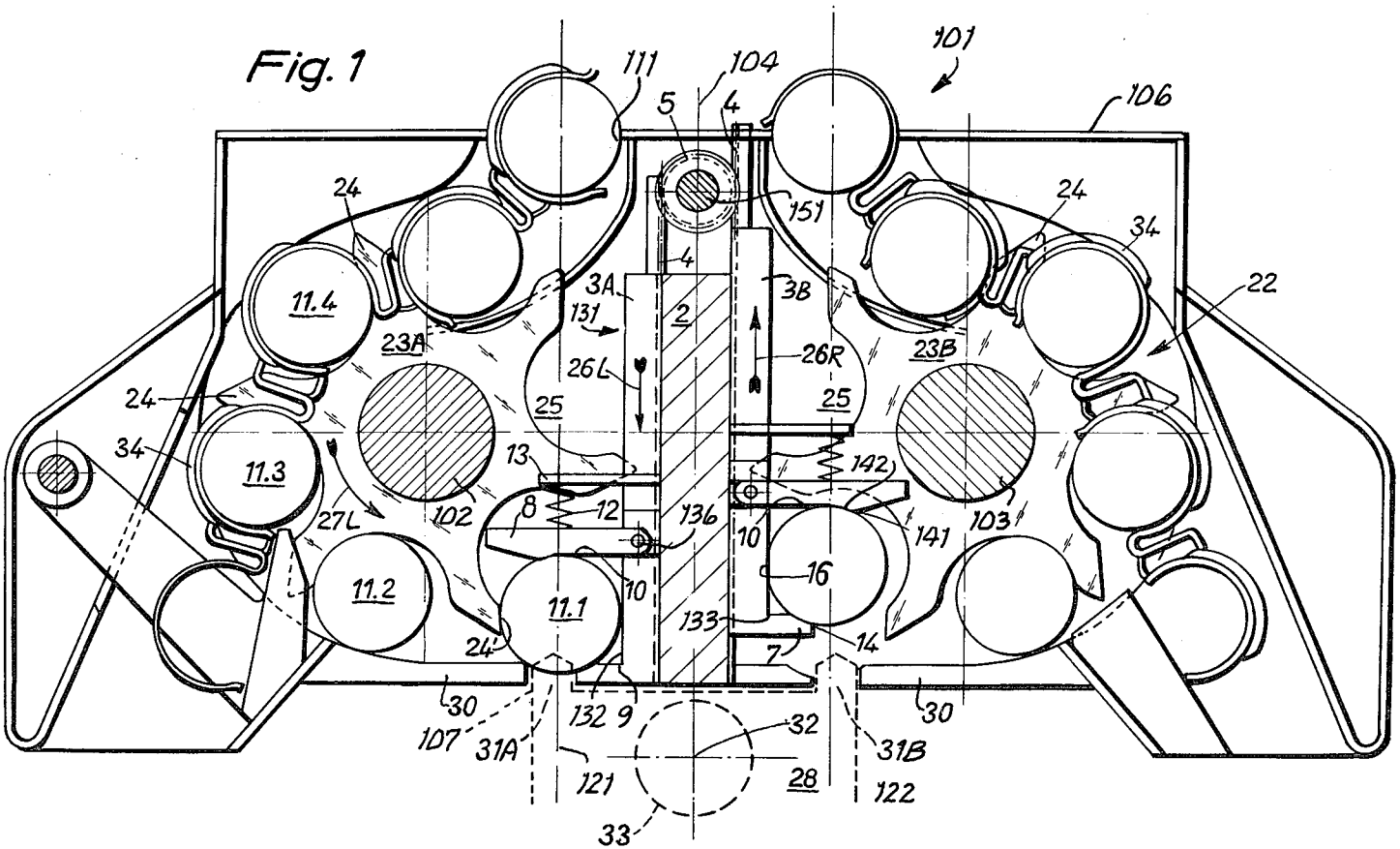
FIG. 1 is a cross-sectional view of a double feed sprocket shell feed arrangement including a feed sprocket selection portion constructed in accordance with the invention, with the selection portion being adapted to transfer shells from the left-hand feed sprocket as viewed in the drawing to a breech piece movable into the plane of the drawing.

Referring now to the drawing, the numeral 101 represents a double-seat feed sprocket arrangement for serially transferring munitions shells, indicated with a numeral 11 and supplemented in some cases by an added decimal, from a selected one of two conventional shell conveyors **23*a* and 23*b* to a breech mechanism 28 of an automatic weapon (not shown). The feed sprockets 23*a* and 23*b* are individually supported for rotation in mutually opposite directions on a pair of shafts 102, 103 which are disposed on opposite sides of a reference vertical axis 104**.

The respective conveyors **23*a*, 23*b* are supported within a composite housing 106 of the arrangement 101. The breech flock 28 is supported for reciprocal movement along an axis 32 perpendicular to the plane of the drawing and through a guide opening 107 in a lower portion 30 of the housing 106**.

The breech flock 28 is provided with a pair of upwardly extending shell-stripping projections **31*a*, 31*b*. The projections 31 extend into the interior of the housing 106 to engage a then-superposed one of the shells 11** in the manner described below.

The breech flock 28 further includes a central shell-receiving chamber 33, which is concentric with the axis 32 and which communicates with the barrel of the weapon for firing the shell. Suitable guide channels (not shown) are also provided in the breech flock 28 for providing communication between the stripping projections 31 and the chamber 33.

The shells to be transferred into the moving breech flock 28 may be loaded into the arrangement 101 in any convenient manner, e.g., the magazine or belt feed. In the particular arrangement shown in the drawing, the shells are introduced into the arrangement 101 via a flexible belt or clip 34, and for this purpose are respectively introduced to the feed sprockets 23*a*, 23*b* via slots 111 in the upper portion of the housing 106. The successive shells 11 disposed along the left-hand belt 34 are introduced into shell-receiving pockets 25 on the feed sprocket 23*a*, where they are conveyed in the counter-clockwise direction indicated by an arrow 27L by means of associated serrations 24 on the feed sprocket when such turnstile is selected for association with the breech flock 28.

Figure 2:
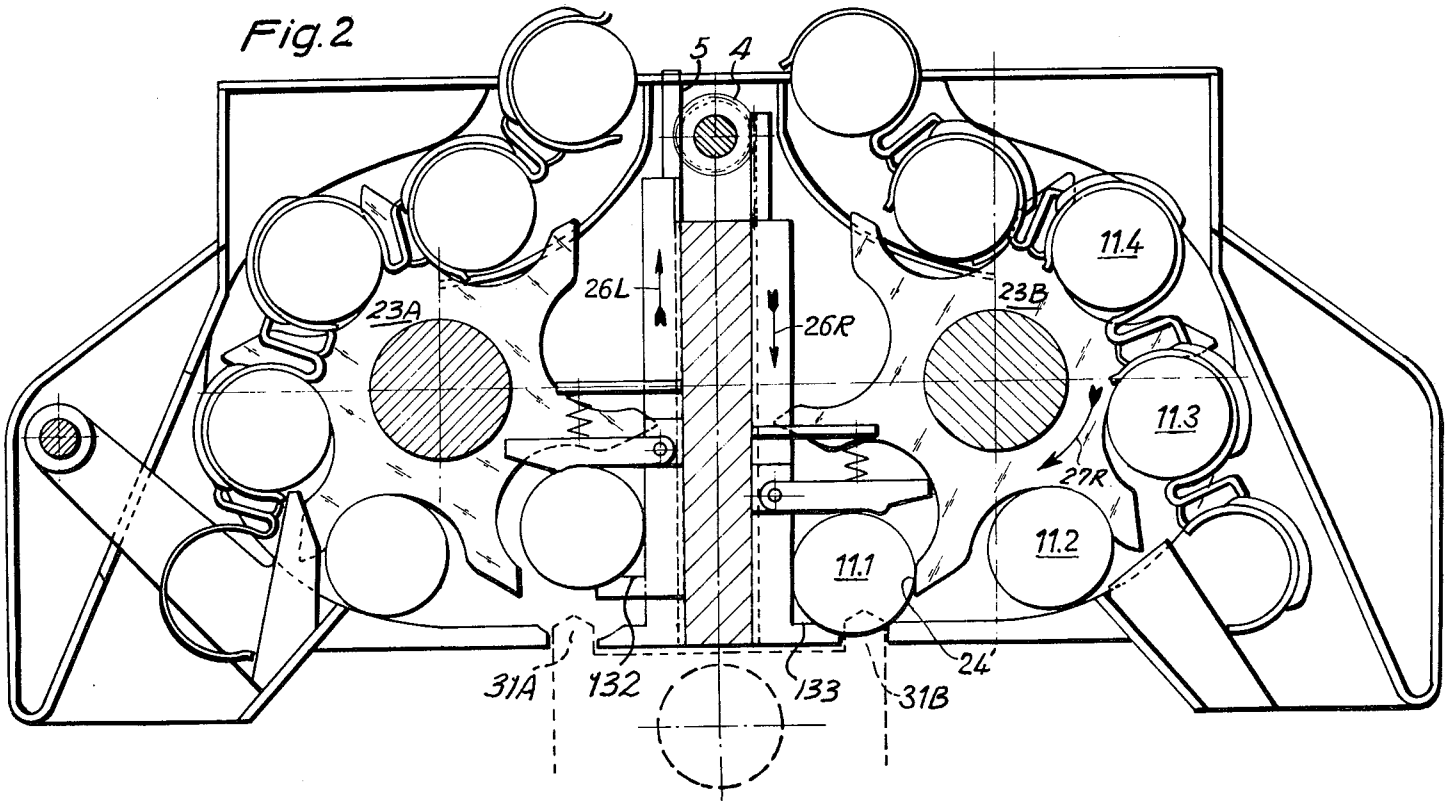
FIG. 2 is a cross-sectional view, similar to FIG. 1, but illustrating the double-sprocket feed arrangement when the transfer portion is adjusted to transfer shells from the righthand turnstile as viewed in the drawing to the moving breech.

In like manner, when shells are to be transferred from the feed sprocket 23*b* to the breech, the shells on the clip 34 are picked up by serrations 24 on such feed sprocket and carried in corresponding pockets 25 in a clockwise direction represented by an arrow 27R (FIG. 2).

The path of movement of the conveyor 23*a* intersects a first vertical plane 121 along which the shell-stripping projection 31*a* of the breech flock 28 extends. In like manner, the path of movement of the conveyor 23*b* intersects a second vertical plane 122 along which the right-hand shell-stripping projection 31*b* extends.

In accordance with the invention, an improved mechanism within the arrangement 101 for selecting the feed sprocket from which shells are to be serially conveyed into the chamber 33 of the breech 28 is represented at 131. The transfer arrangement 131 illustratively includes a pair of elongated displacement blocks 3*a*, 3*b* which are disposed on respectively opposite sides of the vertical axis 104. The block 3*a* is provided with a shell-receiving seat 132 which collaborates with the successive serrations 24 of the conveyor 23*a* for receiving a shell 11 carried in the associated pocket 25, whereby such received shell may be stripped out of the seat 132 by the associated stripping projection 31*a* of the breech flock 28 when such feed sprocket 23*a* is selected by the mechanism 131.

Similarly, a seat 133 is defined on the right-hand block 3*b* for collaberation with the serrations 24 on the feed sprocket 23*b* for receiving a shell carried by a pocket 25 of such feed sprocket 23*b* whereby such shell may be stripped out of the seat 133 by the breech projection 31*b* when the feed sprocket 23*b* is selected by the mechanism 131. In the configuration of FIG. 1, the left-hand feed sprocket 23*b* has been selected as described below while in the arrangement of FIG. 2 the feed sprocket 23*b* has been selected.

The seats 132 and 133 are similarly constructed and opened up towards the respective feed sprocket on opposite sides of the axis 104. Taking the seat 132 as illustrative, such seat is vertically bounded by a fixed projection 7 extending outwardly from the associated block 3*a* and by a superposed projection 8, vertically spaced from the projection 7. The projection 8 is pivotally supported by a pin 136 on the block 3*a*, and is normally biased by a spring 12 downwardly into the horizontal position shown in the figure. The upper end of the spring 12 bears against a fixed abutment surface 13 carried by the block 3*a*.

A lower surface 10 of each support member 8 includes a camming wedge 141 intermediate its ends, and an arcuate portion 142 disposed interior of the wedge 141. The arcuate portion 142 has a curvature that is complementary to the periphery of the shell 11 to be received. In like manner, a curved portion 14 is defined on an upper surface 9 of the bottom projection 7 of the associated seat, such portion 14 being complementary to and contacting a generally opposite portion of the periphery of the shell 11. Thus, upon the urging of the shell into the seat by a surface 24' of a serration 24 on the turnstile 23*a* (FIG. 1), the shell periphery contacts the camming wedge 141 to urge support projection 8 upwardly against the force of the spring 12, thereby permitting the shell to be forced against an inner surface of the block 3*a* intermediate the projection 7 and 8. Once the shell 11 has moved past the wedge 141 against the block 3*a*, the wedge 141 is again urged downwardly by the restoring force of the spring 12 so that the shell 11 is snugly received in the seat 132 in nesting contact with the opposed arcuate portions 142, 14.

In this connection, the arcuate portions 142, 14 may be arranged on diametrically opposite sides of the shell 11. Alternatively, as shown best in FIG. 3, a line 20 connecting the arcuate portions may bisect a horizontal diameter 17 of the shell 11 at a point somewhat outwardly of the center 19 of the shell 11.

The respective blocks 3*a* and 3*b* are separated by an intermediate spacer block 2 (FIG. 1). The blocks 3*a* and 3*b* are further provided with a pair of toothed racks 4, which individually extend upwardly from the upper ends of the blocks in confronting relation. The racks 4 are simultaneously engaged by a control pinion 5, which is affixed to a shaft 151 supported for rotation in the housing 106 in a selected one of two opposite directions. With such arrangement, a rotation of the pinion 5 will move the associated blocks 3*a* and 3*b* in opposite vertical directions simultaneously, whereby in the arrangement of FIG. 1 a counter-clockwise rotation of the pinion 5 will move the block 3*a* downwardly in the direction of an arrow 26L and simultaneously move the block 3*b* upwardly in the direction of an arrow 26R. The engagement of the racks 4 and the pinion 5 are so arranged that the seat 132 defined on the block 3*a* is in its lower most position shown in FIG. 1 while the seat 133 carried by the blocks 3*b* is in the upper most position shown in the same figure.

In the lower most position of the seat 132 shown, a shell 11 then disposed in such seat may be stripped out of such seat upon the next-succeeding pass of the projection 31L of the breech 28. Thus, so long as the mechanism 131 is in the position indicated in FIG. 1 and the turnstile 23*a* with its shells 11 is rotated in the counter-clockwise direction, shells from the belt 34 will be successively transferred by the conveyor 23*a* into the seat 132 and thereafter stripped by the projection 31*a* into the breech 28 in serial fashion.

When it is desired to switch the feed of shells from the feed sprocket 23*a* to the feed sprocket 23*b*, the pinion 5 is rotated in the clockwise direction until the seats 132, 133 are in the relative positions shown in FIG. 2, i.e., with the seat 133 in its lower most position and the seat 132 in its upper most position.

In this position, the right-hand projection 31*b* of the breech 28 successively strips shells in the seat 133 as the breech 28 moves into the plane of the drawing following each transfer of a shell from the feed sprocket 23*b* to the seat 133 as the feed sprocket turns in the clockwise direction shown. Such transfer shells from the right-hand belt 34 to the breech 28 via the feed sprocket 23*b* and the mechanism 131 will continue so long as the conditions indicated in FIG. 2 are met.

It will be noted that with the vertical disposition of the transfer mechanism 131 and the equal and opposite movements of the blocks 31*a* and 31*b* due to the collaboration of the pinion 5 and the associated racks 4, the net force needed to operate the mechanism 131 will essentially be limited to that necessary to overcome the friction of the engaged load on the pinion 5. Such load, and the force necessary to overcome it, is obviously significantly less than that exhibited by the heavy and bulky horizontally-movable transfer arrangements of the prior art.

Figure 3:
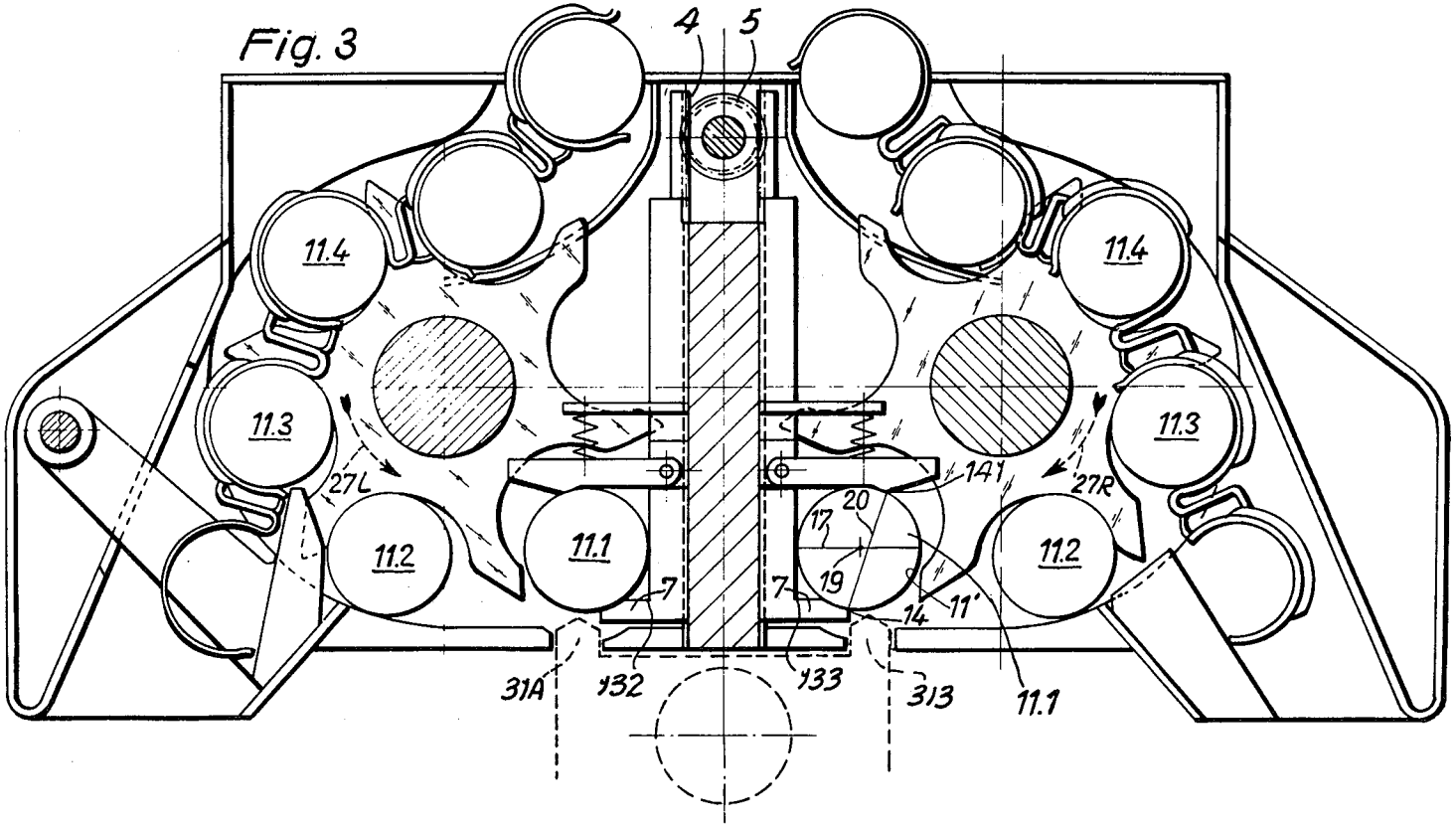
FIG. 3 is a cross-sectional view similar to FIGS. 1 and 2 but showing the feed sprocket selection portion in its neutral position.

An additional advantageous feature of the invention is shown in FIG. 3. As indicated, the transfer mechanism 131 has been positioned, via a suitable rotation of the pinion 5, to a position where the respective seats 132 and 133 are in horizontally aligned relation between their lower and upper positions shown in FIGS. 1 and 2. The collaboration of the racks 4 and the pinion 5 are further adjusted, in such case, so that in the intermediate position shown in FIG. 3 the shells 11 carried in the nests 132 and 133 are out of contact with the stripping projections 31*a* and 31*b* on the breech 28. Thus, by simply positioning the pinion 5 to a central position intermediate those corresponding to FIGS. 1 and 2, the mechanism 131 is effectively situated in a stable neutral or safety position without the necessity of complicated auxiliary apparatus as in the prior art. It will be noted that in such safety position, it is impossible to transfer the shell from the seats 132 or 133 into the firing chamber 33 of the breech, so that the firing of the associated weapon would be ineffective to discharge a shell.

In the foregoing, an illustrative arrangement of the invention has been described. Many variations and modifications will now occur to those skilled in the art. It is accordingly desired that the scope of the appended claims not be limited to the specific disclosure herein contained.

What is claimed is:

1. In a double-feed arrangement for introducing munitions shells into an elongated breech of an automatic weapon having a breech block movable along a first axis through the feed arrangement for serially receiving shells therefrom, the breech block having first and second shell-engaging regions disposed on opposite sides of the first axis and extending upwardly in first and second planes, the feed arrangement comprising, in combination, first and second feed sprockets individually supported for rotation around second and third axes on opposite sides of and closely adjacent to the first axis thereof with the breech block being movable through the space between the feed sprockets, the feed sprockets respectively having a plurality of circumferentially spaced shell-receiving pockets therein for successively conveying shells along individual first and second paths extending through the first and second planes as the feed sprockets are rotated, first and second receptacle means for receiving shells from the respective feed sprockets to be selectively transferred to one of the shell-engaging regions of the breech block, means supporting the first and second receptacle means for reciprocal movement along the first and second planes, respectively, between aligned lower positions disposed in the path of movement of the first and second shell-engaging regions of the breech block and aligned upper positions spaced from said path of movement, and reversible control means coupled jointly to the first and second receptacle means for simultaneously moving the receptacle means vertically in mutually opposite directions along the respective first and second planes into selected positions between and including the upper and lower positions, when in said between position either receptacle means keeping a respective shell outside the respective shell-engaging region of the breech.

2. Apparatus as defined in claim 1, in which each receptacle means comprises, in combination, first and second elongated, vertically disposed displacement blocks, first and second elongated support members individually extending from vertically spaced portions of each block toward the associated feed sprocket, means for securing the lower one of the support members to the associated portion of the block, means mounting the upper one of the support members for pivotal movement about the associated portion of the block in a vertical plane, and means for biasing the upper support member downwardly into a substantially horizontal normal position, the space defined by the region of each block between the upper and lower portion thereof and the confronting faces of the upper and lower support members collectively defining a seat for a shell received from the associated turnstile.

3. Apparatus as defined in claim 2, in which the control means comprises, in combination, a pair of toothed racks extending upwardly from and secured to the respective displacement block in confronting relation, a pinion disposed between and in driving engagement with the confronting racks, and means for rotating the pinion in a selected one of two opposite directions.

4. Apparatus as defined in claim 3, in which the respective vertical positions of the racks and pinion are chosen so that the seat associated with the first displacement block is in the lower position of the associated receptacle means while the seat associated with the other of the blocks is in the upper position of the associated receptacle means, and vice versa, the seats being in horizontal alignment at a first mean position between the upper and lower positions.

5. Apparatus as defined in claim 4, in which the spacing between the upper and lower positions of each receptacle means is selected so that at the aligned first mean position of the seats, the respective shells then carried by such seats are each out of engagement with the associated one of the shell-engaging regions of the breech.

6. Apparatus as defined in claim 2, in which the confronting surfaces of the upper and lower support members of each seat have collaborating arcuate portions thereon aligned with and corresponding to generally opposite regions of the periphery of the shell received thereby.

7. Apparatus as defined in claim 6, in which the lower surface of the upper support member of each seat has a downwardly extending camming wedge portion exterior of the associated arcuate portion, whereby a transfer of the shell from the associated feed-sprocket to the seat effects contact of the shell with the wedge to move the upper support member upwardly against the force of the biasing means, such wedge moving downwardly again under the restoring force of such biasing means after the shell has been moved inwardly past the wedge and into contact with the associated arcuate portion.

* * * * *

UNITED STATES PATENT OFFICE

CERTIFICATE OF CORRECTION

Patent No. 4,119,012 Dated October 10, 1978

Inventor(s) Guenter FRYE

It is certified that error appears in the above-identified patent and that said Letters Patent are hereby corrected as shown below:

column 2, line 51, change "flock" to --block--;

line 55, change "flock" to --block--;

line 60, change "flock" to --block--;

line 64, change "flock" to --block--;

line 68, change "flock" to --block;

column 3, line 13, change "flock" to --block--;

line 22, change "flock" to --block--;

line 39, change "flock" to --block--.

Signed and Sealed this

*Seventeenth* Day of *April 1979*

[SEAL]

*Attest:*

RUTH C. MASON
*Attesting Officer*

DONALD W. BANNER
*Commissioner of Patents and Trademarks*